United States Patent [19]

Dense

[11] Patent Number: 5,012,554

[45] Date of Patent: May 7, 1991

[54] AUTOMATIC ANCHORING SYSTEM FOR WINDOW SPRING

[75] Inventor: Brian S. Dense, Rochester, N.Y.

[73] Assignee: Caldwell Manufacturing Company, Rochester, N.Y.

[21] Appl. No.: 422,754

[22] Filed: Oct. 17, 1989

[51] Int. Cl.[5] ..... E05D 13/00; E05F 1/00

[52] U.S. Cl. ..... 16/197; 49/445

[58] Field of Search ..... 16/197, 193; 267/179; 49/445, 446

[56] References Cited

U.S. PATENT DOCUMENTS

| | | | |
|---|---|---|---|
| 2,786,230 | 3/1957 | Hettinger | 16/197 |
| 3,034,170 | 5/1962 | Koebel | 16/197 |
| 3,077,631 | 2/1963 | Erck | 16/197 |
| 3,332,171 | 7/1967 | Beil | 49/445 |
| 3,432,883 | 3/1969 | Erck | 16/197 |
| 4,190,930 | 3/1980 | Prosser | 16/197 |
| 4,685,175 | 8/1987 | Yonovich | 16/197 |

*Primary Examiner*—Richard K. Seidel
*Assistant Examiner*—Carmine Cuda
*Attorney, Agent, or Firm*—Eugene Stephens & Associates

[57] ABSTRACT

A top clip (20) automatically anchors a window spring (15) at the upper end of a jamb liner spring cover (11) having a generally D-shaped cross section. The top clip has a body (21) that interlocks with the upper coils of spring (15) and has a rounded nose (26) that helps guide the body inside the upper end of spring cover (11). The top of body (21) has a flange (22) that overlaps the upper end of the spring cover, and the periphery of the flange has retainer tangs (25) that extend downward to overlap the outer surface of the spring cover. If a spring is accidentally snapped during assembly, top clip (20) and spring (15) are free to move above the upper end of spring cover (11) and can be returned to an anchored position, simply by pulling downward on the spring and the top clip.

16 Claims, 1 Drawing Sheet

AUTOMATIC ANCHORING SYSTEM FOR WINDOW SPRING

BACKGROUND

Top clips for anchoring window counterbalance springs on the spring covers of jamb liners have been troublesome. Sometimes during window assembly, the spring inside the spring cover is stretched and snapped loose, causing the spring to retract rapidly; and as a snapping spring goes coil-to-coil, the snap force is transmitted to the top of the spring. This can dislodge or break the anchorage that holds the upper end of the spring in place at the top of the spring cover. If the anchorage dislodges, the assembler must stop and waste time reinstalling the top clip on the spring cover; and if the anchorage or jamb liner breaks, the assembler must discard these parts and replace them with new parts, which can take even more time and expense. Either event adds to the cost of window assembly.

A U.S. Pat. No. 4,685,175, assigned to the assignee of this application, proposed a top clip that overlapped the top of the spring cover and anchored in place within the spring cover by a pair of wedged pins retained in holes in an upper region of the spring cover. Upward snapping spring force applied to this top clip can not only dislodge it from its anchored position, but can break the resin material of the jamb liner above the holes in which the top clip is anchored.

U.S. Pat. No. 4,190,930 suggests a top clip that hooks over and lodges in openings in an upper region of a jamb liner, but this top clip is used with a block and tackle balance system that is not subject to upward snapping force during assembly.

Other prior art top clips are formed by bending the uppermost coil of the spring into a hook that hooks over an upper edge of the spring cover. These can unseat the hook if the spring is snapped upward, and this requires repositioning the hook before proceeding with window assembly. Such hooks are also the weakest part of the spring and are likely to break during use.

These problems suggest a more firmly anchored top clip that cannot be dislodged during spring snapping force and is anchored in place securely enough so that no damage is done if the spring snaps. Work on such a concept has lead to a quite different solution, however. I have devised a top clip that is free to snap upward above the top of the spring cover, if the spring snaps, and that automatically reseats itself in an anchored position at the top of the spring cover, simply by pulling the spring and top clip back downward. A snapping spring then causes no damage to the top clip or the jamb liner and takes practically no time to restore, because the snapped spring merely has to be pulled back down. My anchoring system also accomplishes this with a simple and inexpensive top clip that functions reliably during the life of the window system.

SUMMARY OF THE INVENTION

My automatic anchoring system leaves a top clip free to snap upward above the upper end of a jamb liner spring cover and ensures that the top clip returns to an anchored position, simply by pulling the spring and the top clip downward into the spring cover. To work this way, my top clip attaches to the upper coils of the spring so that a body of the top clip extends concentrically around and above an upper region of the spring. The body is sized to fit within the spring cover, and a flange extends radially outward at the top of the body and is sized for overlapping the upper end of the spring cover so that the flange cannot move downward below the upper end of the spring cover. Retainer tangs that preferably have pointed lower ends are spaced radially outward from the body around an outer perimeter of the flange so that the tangs extend downward from the flange around an outside of the spring cover. The lower end of the body is rounded to guide the body into the inside of the upper region of the spring cover as the top clip moves downward with the spring and the flange approaches engagement with the upper end of the spring cover.

Such a top clip can seat reliably in an anchored position on an upper end of the spring cover in any angular orientation. If a retainer tang in its downward movement encounters an upper edge of the spring cover, the pointed lower end of the retainer tang guides it either inside or outside of the spring cover wall. Enough retainer tangs are positioned around the perimeter of the flange so that at least two tangs always engage the outside surface of the spring cover. Anchoring the top clip in place can then be accomplished simply by pulling the spring and the top clip downward until the flange of the top clip overlaps the upper end of the spring cover.

If the spring is snapped during assembly, it can snap the top clip upward above the spring cover, but this does no harm to either the top clip or the jamb liner. The anchorage is also easy to restore, simply by pulling downward on the spring, to lower the top clip back into engagement with the upper end of the spring cover.

DRAWINGS

FIG. 1 is a fragmentary, elevational view of a preferred embodiment of my automatic anchoring system applied to a jamb liner having a pair of spring covers and showing one top clip in a snapped up position and another top clip in an anchored position.

FIG. 2. is a cross-sectional view of the embodiment of FIG. 1, taken along the line 2—2 thereof.

DETAILED DESCRIPTION

Figure 1:
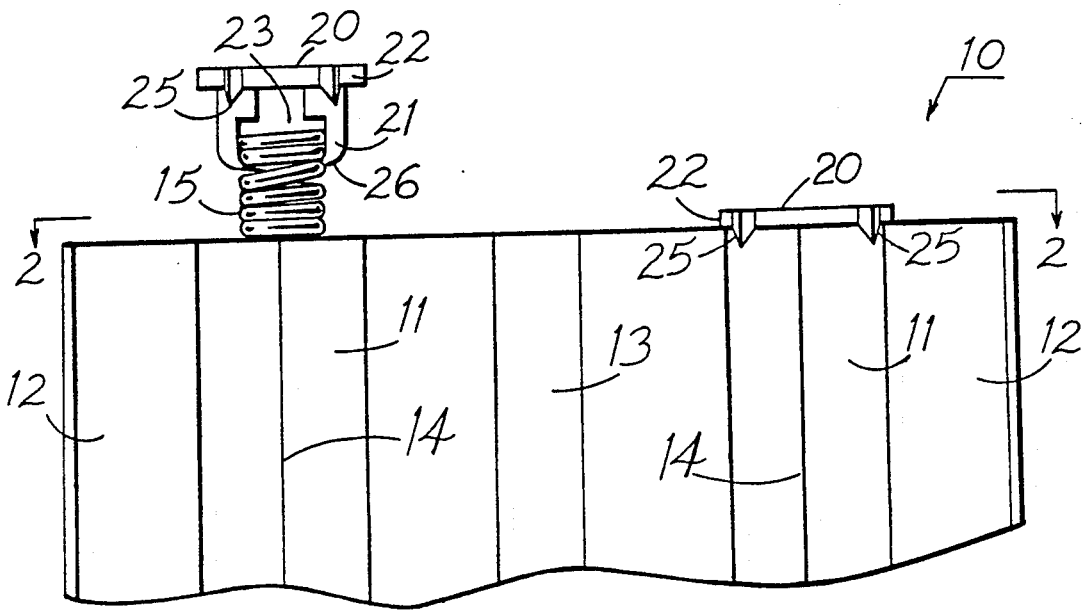

My automatic anchoring system applies to a jamb liner 10 having a spring cover 11 that is generally D-shaped in cross section. Jamb liner 10 can be made of aluminum or an extruded resin material such as polyvinyl chloride. The one illustrated in FIG. 1 is extruded of resin and has a pair of spring covers 11 for a pair of sash runs 12 separated by a parting bead 13. A counterbalance spring 15 is arranged within each spring cover 11 and is anchored at the top of each spring cover 11.

Figure 2:
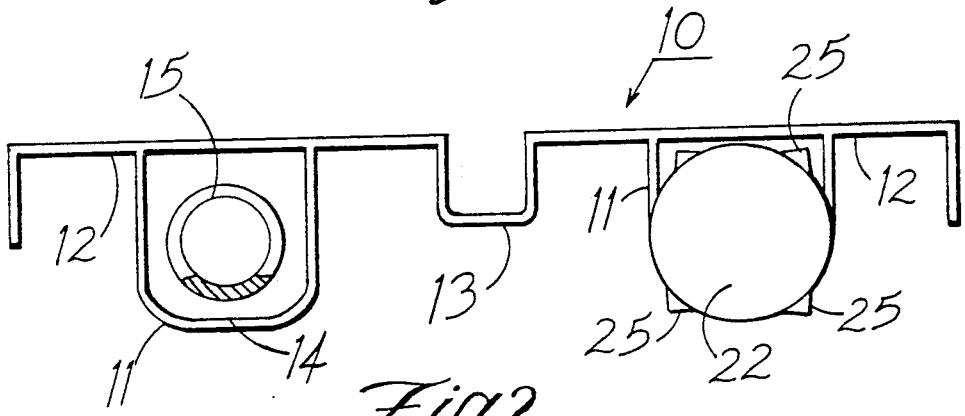
Figure 3:
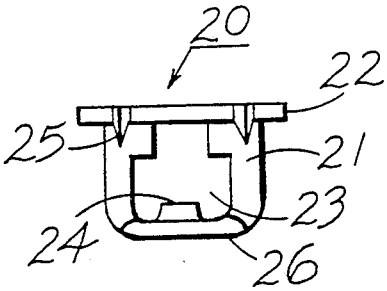
FIG. 3 is a front elevational view of a preferred embodiment of my top clip unattached to a spring.
Figure 4:
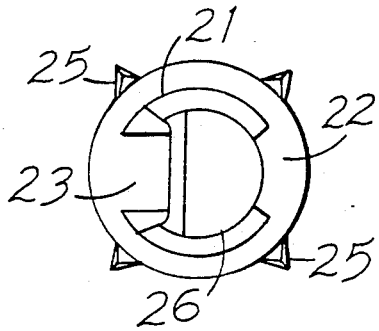
FIG. 4 is a bottom view of the top clip of FIG. 3.

In the embodiment of FIGS. 1 and 2, spring covers 11 have central slits 14 dividing each spring cover into two parts, but many spring covers of this general type are not divided by a slit. My automatic anchoring system works equally well whether the spring cover is slit or not.

As best shown in FIG. 2, each spring cover 11 has a rounded semi-cylindrical region, making each spring cover 11 generally D-shaped in cross section. This is a conventional shape for spring covers of jamb liners for windows that cannot be taken out from between a pair of jamb liners.

My top clip 20 is preferably molded of resin material with a body 21 and a flange 22. Body 21 is sized for fitting inside an upper region of a spring cover 11, and body 21 is preferably cylindrical, with a through recess 23 to receive window spring 15. A wedge retainer 24 positioned at the bottom of recess 23 is arranged for interlocking between terminal coils of spring 15 in a generally known way that mounts top clip 20 securely on the upper region of spring 15, as shown in FIG. 1. In mounted position, body 21 extends concentrically around the upper coils of spring 15 and extends vertically above the uppermost coil of spring 15. Top clip 20 thus holds its position on spring 15 and moves up and down with spring 15.

Flange 22 has a large enough diameter to overlap the semi-cylindrical upper end of a spring cover 11, as shown in FIG. 2. This prevents flange 22 from moving below the upper end of spring cover 11. Although top clip 20 is free to move above spring cover 11, as shown in FIG. 1, top clip 20 cannot move below the position shown in the right side sash run 12 of FIG. 1. Flange 22 is also preferably circular so that it can engage the upper end of spring cover 11 in an anchored position in any angular orientation.

Retainer tangs 25 extend downward from the periphery of flange 22 and are spaced radially outward from body 21 so that retainer tangs 25 overlap with the outside surface of spring cover 11. The lower ends of retainer tangs 25 are preferably pointed, as illustrated, so that they slide down automatically into an overlapped position with the outside of spring cover 11. If one of the retainer tangs 25 encounters an upper edge of spring cover 11 as the tang moves downward toward an anchored position, its pointed lower end helps it move either inside or outside of spring cover 11.

Enough retainer tangs 25 are positioned around the perimeter of flange 22 so that at least two retainer tangs 25 overlap the semi-cylindrical outside surface of spring cover 11, as illustrated. I prefer four retainer tangs 25 equally spaced around the perimeter of flange 22; and as shown at the right side of FIG. 2, two retainer tangs 25 are outside of spring cover 11, and two retainer tangs 25 are inside of spring cover 11. The retainer tangs 25 that are positioned outside of spring cover 11 help hold the spring cover against any expansion of slit 14, so that the upper region of spring cover 11 cannot spread open and allow flange 22 of top clip 20 to move downward below the upper end of spring cover 11. Of course, this is not a problem with spring covers that do not have slits 14.

A lower region of body 21 has a rounded nose 26 that surrounds spring 15 when top clip 20 is mounted on spring 15. A beveled or rounded nose 26 helps guide the body 21 of top clip 20 into the inside of spring cover 11 when moved downward from above the top of spring cover 11. This also helps ensure that flange 22 moves down to an overlapping position on the upper end of spring cover 11, with at least a pair of retainer tangs 25 extending downward around the outside of spring cover 11.

My top clip 20 automatically seats in an anchored position, as shown at the right sides of FIGS. 1 and 2, every time that spring 15 and top clip 20 are moved downward into spring cover 11 to bring flange 22 into engagement with the upper end of spring cover 11. The angular orientation of top clip 20 does not interfere with its automatic anchoring, because pointed retainer tangs 25 guide flange 22 into an anchored overlap with the upper end of spring cover 11 at any approach orientation. Tangs 25 help hold flange 22 in its overlapped and anchored position, from which the body 21 of top clip 20 reliably supports spring 15 in place within spring cover 11.

If spring 15 is accidentally snapped during assembly, the upward snapping force can drive top clip 20 above the upper end of spring cover 11, as shown at the left side of FIG. 1. This does not break top clip 20 or damage jamb liner 10, however; and a snapped up spring 15 can be restored to anchored position, simply by pulling spring 15 and top clip 20 back down into spring cover 11.

I claim:

1. An automatic anchoring system for retaining a window spring on an upper end of a jamb liner spring cover that is generally D-shaped in cross section, said anchoring system comprising:
   a. a top clip with a body sized for fitting inside said spring cover and connected to an upper region of said spring so that said body extends above a top end of said spring around an axis of said spring;
   b. a lower region of said body having a rounded nose extending around said spring;
   c. an upper region of said body having a flange extending radially outward far enough to overlap with said upper end of said spring cover so that said flange cannot move downward below said upper end of said spring cover;
   d. said top clip and said spring being free to move upward above said upper end of said spring cover, and said rounded nose being positioned for guiding said body into said upper end of said spring cover as said body and said spring move downward into said spring cover; and
   e. a plurality of retainer tangs spaced around an outer periphery of said flange and extending downward from said flange so that at least two of said tangs fit over an outside surface of said spring cover when said flange moves down into engagement with said upper end of said spring cover in any of a plurality of angular orientations.

2. The system of claim 1 wherein said retainer tangs have pointed lower ends and are spaced radially outward from said body.

3. The system of claim 1 wherein said flange is circular and said retainer tangs are spaced evenly around said outer periphery of said flange.

4. The system of claim 1 wherein the connection of said body to said spring includes a wedge retainer inserted between coils of said upper region of said spring.

5. A method of automatically anchoring a window spring in a jamb liner spring cover that is generally D-shaped in cross section, said method comprising:
   a. attaching a top clip to an upper region of said spring so that said top clip extends above an upper end of said spring;
   b. lowering said spring and said top clip downward into said spring cover from above an upper end of said spring cover so that said top clip guides into an inside of said spring cover and a radially extending flange of said top clip seats against said upper end of said spring cover with retainer tangs extending downward from a perimeter of said flange to fit around an outside of said spring cover in any of a plurality of angular orientations of said top clip relative to said spring cover;

c. leaving said spring and said top clip free to snap upward above said upper end of said spring cover if said spring is snapped loose; and d. reseating said top clip flange against said upper end of said spring cover by moving said spring and said top clip downward from a snapped up position above said upper end of said spring cover.

6. The method of claim 5 including attaching said top clip to said upper region of said spring by inserting a wedge retainer in between coils of said upper region of said spring.

7. The method of claim 5 including rounding a lower end of said top clip to aid in guiding said top clip into said inside of said spring cover.

8. The method of claim 5 including pointing the lower ends of said retainer tangs so that said retainer tangs do not lodge against said upper end of said spring cover.

9. A top clip for anchoring a window spring to an upper end of a jamb liner spring cover that has a semi-cylindrical portion and is generally D-shaped in cross section, said top clip comprising:

a. a circular flange sized to overlap an upper end of said semi-cylindrical portion of said spring cover;

b. a plurality of retainer tangs spaced from each other around an outer perimeter of said flange and extending downward to fit around an outer surface of said semi-cylindrical portion of said spring cover, said flange and said tangs being able to engage said upper end of said spring cover in any of a plurality of angular orientations;

c. a body of said top clip extending below said flange, said body being spaced radially inward from said retainer tangs and being sized to fit within the inside of said semi-cylindrical portion of said spring cover;

d. a lower region of said body having a rounded nose;

e. said lower region of said body having a recess for receiving upper end coils of said spring; and f. a bottom wall of said recess having a wedge connector positioned for interlocking between said upper end coils.

10. The top clip of claim 9 wherein said retainer tangs have pointed lower ends.

11. The top clip of claim 9 wherein said recess extends transversely through said body.

12. The top clip of claim 9 including at least four of said retainer tangs.

13. An automatic anchoring system for retaining a window spring at an upper end of a jamb liner spring cover that is generally D-shaped in cross section, said anchoring system comprising:

a. a top clip attached to upper coils of said spring so that a body of said top clip extends concentrically around an upper region of said spring and extends above an upper end of said spring;

b. a flange of said top clip at an upper region of said body being sized for overlapping said upper end of said spring cover so that said flange cannot move downward below said upper end of said spring cover;

c. a plurality of retainer tangs spaced around an outer perimeter of said flange and spaced radially outward from said body to extend downward from said flange around an outside of said spring cover; and d. a lower end of said body being rounded to guide said body into an inside of an upper region of said spring cover when said top clip moves downward with said spring as said flange approaches engagement with said upper end of said spring cover.

14. The system of claim 13 wherein said retainer tangs have pointed lower ends.

15. The system of claim 13 wherein said flange is circular, and at least four of said retainer tangs are spaced around said flange.

16. The system of claim 13 wherein said body of said top clip has a transverse recess containing a retainer wedge that is pressed between said upper coils of said spring for attaching said top clip to said spring.

* * * * *